US007516798B2

(12) United States Patent
Wood et al.

(10) Patent No.: US 7,516,798 B2
(45) Date of Patent: Apr. 14, 2009

(54) COILED TUBING TRANSPORT SYSTEM AND METHOD

(75) Inventors: Thomas D. Wood, Calgary (CA); Randolph M. Charron, Calgary (CA)

(73) Assignee: Xtreme Coil Drilling Corp., Calgary, Alberta (CA)

( * ) Notice: Subject to any disclaimer, the term of this patent is extended or adjusted under 35 U.S.C. 154(b) by 21 days.

(21) Appl. No.: 11/155,056

(22) Filed: Jun. 17, 2005

(65) Prior Publication Data

US 2006/0283605 A1 Dec. 21, 2006

(51) Int. Cl.
*E21B 19/22* (2006.01)
*B65H 67/02* (2006.01)

(52) U.S. Cl. ..... 166/380; 166/384; 166/385; 166/77.2; 242/403; 242/557

(58) Field of Classification Search ..... 166/380, 166/77.2, 77.3, 77.4, 384, 385; 242/403, 242/557

See application file for complete search history.

(56) References Cited

U.S. PATENT DOCUMENTS

| | | | | |
|---|---|---|---|---|
| 3,734,210 | A | 5/1973 | Wilderman | |
| 4,515,220 | A | 5/1985 | Sizer et al. | |
| 4,655,291 | A | 4/1987 | Cox | |
| 5,244,046 | A | 9/1993 | Council et al. | |
| 5,738,173 | A | 4/1998 | Burge et al. | |
| 5,765,643 | A | 6/1998 | Shaaban et al. | |
| 6,003,598 | A | 12/1999 | Andreychuk | |
| RE36,556 | E | 2/2000 | Smith et al. | |
| 6,092,756 | A * | 7/2000 | Sola | 242/399.2 |
| 6,158,516 | A | 12/2000 | Smith et al. | |
| 6,273,188 | B1 * | 8/2001 | McCafferty et al. | 166/77.2 |
| 6,609,565 | B1 | 8/2003 | Andreychuk et al. | |

(Continued)

FOREIGN PATENT DOCUMENTS

| | | |
|---|---|---|
| CA | 2292214 | 6/2001 |
| CA | 2425448 | 2/2005 |

OTHER PUBLICATIONS

Foremost Heavy-Duty Hydraulic Top Drive—Model F—100T, Specification, Quotation to Grey Wolf Drilling, Mar. 15, 2005, 6 pages.

*Primary Examiner*—Nicole Coy
(74) *Attorney, Agent, or Firm*—Browning Bushman PC

(57) ABSTRACT

A coiled tubing transfer system comprising a carrier having a bed, the bed having a width and the length, the length of the bed being longer than the width of the bed, a reel removably supported on the bed, the reel comprising a spool rotatably journaled in first and second supports, the spool having a core with a diameter and long axis extending between the supports, the long axis having a length greater than the width of the bed, the reel being positionable on the bed in a first position with the long axis of the core extending lengthwise of the bed, the longest dimension of the reel transverse to the long axis of the core being less than the width of the bed and a length of coiled tubing useable in earth borehole operations being wound around the core, the coiled tubing having an outside diameter of from 1" to 9", the ratio of the diameter of the coiled tubing to the diameter of the core being from 1:20 to 1:70.

18 Claims, 8 Drawing Sheets

U.S. PATENT DOCUMENTS

2003/0098150 A1 5/2003 Andreychuk
2003/0226667 A1* 12/2003 Hill ..... 166/384
2004/0206551 A1 10/2004 Carriere et al.
2005/0247456 A1* 11/2005 Wise et al. ..... 166/384

* cited by examiner

COILED TUBING TRANSPORT SYSTEM AND METHOD

BACKGROUND OF THE INVENTION

1. Field of the Invention

The present invention relates to coiled tubing used in earth borehole operations such as oil and gas well drilling and servicing. More particularly, the present invention relates to a system and method for transporting and using coiled tubing.

2. Description of Prior Art

The widespread and expanding use of coiled tubing in earth wellbore operations such as in the drilling and/or servicing of oil and gas wells is well known. The use of coiled tubing minimizes the time and expense typically involved in using jointed pipe or jointed tubing. Additionally, coiled tubing can be used with a variety of downhole equipment such as stabilizers, drill motors, bits, well servicing tools, etc.

A typical coiled tubing rig comprises a reel of coiled tubing mounted on a platform or vehicle, an injector to run the tubing into and out of the well, a gooseneck or guide affixed to the injector for guiding the coiled tubing between the reel and the injector, a lifting device to support the injector and gooseneck, a hydraulic power pack to provide power to the reel and the injector and to other hydraulic equipment, and surface equipment such as strippers and blowout preventers to seal around the coiled tubing as it is run into and out of the well. The carrier used to transport the reel is typically a trailer or skid. The reel may be of various sizes, depending upon the size of the coiled tubing to be reeled thereupon, and the length of coiled tubing to be carried.

In the early applications of coiled tubing use, the coiled tubing was of a relatively small diameter, typically approximately 1" OD. The use of such small diameter tubing provided the maximum amount of tubing which could possibly be mounted on a reel to be transported to and from the well site. This is important, because the size of the reel which can be transported to the well site is limited by regulations governing the roads over which the reel is to be transported, i.e., the height and width dimensions of a load transversing such roads is controlled. Thus, there is an inherent limitation on the length of coiled tubing that can be transported over such government regulated roads, etc. Further, the use of such small diameter coiled tubing limits the flow of fluids there through, limits the amount of compressive force that can be transmitted through the string of tubing to the well, limits the amount of tension that can be placed on the string of tubing, limits the amount of torque that the tubing can withstand and limits the type and weight of tools that can be used and, increasingly important, limits the length of tubing that may be used.

To overcome some of the difficulties noted above, larger sizes of coiled tubing have come into use, in diameters ranging up to 4½ inches, or even greater. However, the use of such large diameter coiled tubing with small reels designed for the smaller diameter tubing creates problems. As noted above, the size (height and width) of the reel on which the coiled tubing is shipped is limited primarily by government regulation of roads over which the tubing is to be shipped. Accordingly, under current regulations even large diameter tubing must be shipped on relatively small diameter reels. This severely limits the length of such large diameter tubing that can be moved to a site. Additionally, it is common that the tubing used at the well site is on the same reel on which it was shipped. This can involve repeated reeling and unreeling of large diameter coiled tubing on a small reel, increasing the fatigue from bending stresses.

Whether it be small diameter, e.g., 1", or large diameter, e.g., 4½ inch or greater, coiled tubing, under current government regulation of roads on which the tubing is to be shipped, the amount of coiled tubing on a reel is limited for a reel with a given size vis-a-vis core diameter and winding space on the reel. Thus, more smaller diameter tubing can be reeled and shipped than larger diameter tubing. Stated differently, the smaller the diameter of the tubing, the larger the length of tubing that can be shipped on a given reel. There is an increasing desire to use coiled tubing, regardless of its size, in deeper and deeper wells. However, with the present system, regardless of the diameter, a single reel of coiled tubing typically does not contain a long enough length of tubing to achieve the desired depth of some deeper wells, necessitating that some sort of field splicing be employed to achieve the desired longer length. It is well known that splicing is time consuming and potentially dangerous since the integrity of the splice is typically considerably less than the integrity of the coiled tubing itself.

SUMMARY OF THE INVENTION

In one preferred embodiment, the present invention provides a coiled tubing transfer system comprising a first carrier having a first bed, the bed having a width and a length, the length of the bed being longer than the width of the bed. There is a reel removably supported on the first bed, the reel comprising first and second spaced supports, a spool being rotatably journaled in the first and second supports. The spool has a core with a diameter and a long axis extending between the first and second supports, the long axis having a length greater than the width of the first bed. The reel is positionable on the first bed in a first position with the long axis of the core extending lengthwise of the first bed, the longest dimension of the reel that is transverse to the long axis being approximate to or less than the width of the first bed. A length of coiled tubing, useable in earth borehole operations, is wound around the core, the coiled tubing having an outside diameter of from 1" to 9", the ratio of the diameter of the coiled tubing to the diameter of the core being from 1:20 to 1:70.

In another preferred embodiment, the present invention provides a method of transporting and using a reel of coiled tubing. The method comprises providing a carrier having a first bed, the first bed having a width and a length, the length being longer than the width. The method further comprises positioning a reel of coiled tubing on the bed, the reel comprising first and second spaced supports, a spool being rotatably journaled in the first and second supports, the spool having a core with a diameter and a long axis extending between the first and second supports. The long axis has a length that is greater than the width of the bed and the reel is positionable on the first bed in a position with the long axis of the core extending lengthwise of the bed, the longest dimension of the reel that is transverse to the long axis being approximate to or less than the width of the bed. The method further includes providing a length of coiled tubing wound around the core, the coiled tubing being of a type used in earth borehole operations, the coiled tubing having an outside diameter of from 1" to 9", the ratio of the diameter of the coiled tubing to the diameter of the core being from 1:20 to 1:70. The method additionally comprises transporting the carrier and the reel carrying the length of coiled tubing to a desired site, connecting coiled tubing from the reel to a coiled tubing injector, and utilizing the coiled tubing in an earth borehole operation.

DESCRIPTION OF THE PREFERRED EMBODIMENTS

The coiled tubing which is the subject of the present invention is of the type used in earth borehole operations, particularly in the drilling and/or servicing of oil and gas wells. However, it is understood that the coiled tubing can be used in other earth borehole operations, e.g., mining, water wells, injection wells, etc. While coiled tubing of the type under consideration is generally made of steel, coiled tubing made from composites such as fiberglass, carbon fibers, and other synthetic materials can also be employed. Indeed, since composites generally have greater elasticity, coiled tubing made of composites can be more tightly wound, e.g., on a smaller diameter spool, without undergoing permanent deformation.

Figure 4:
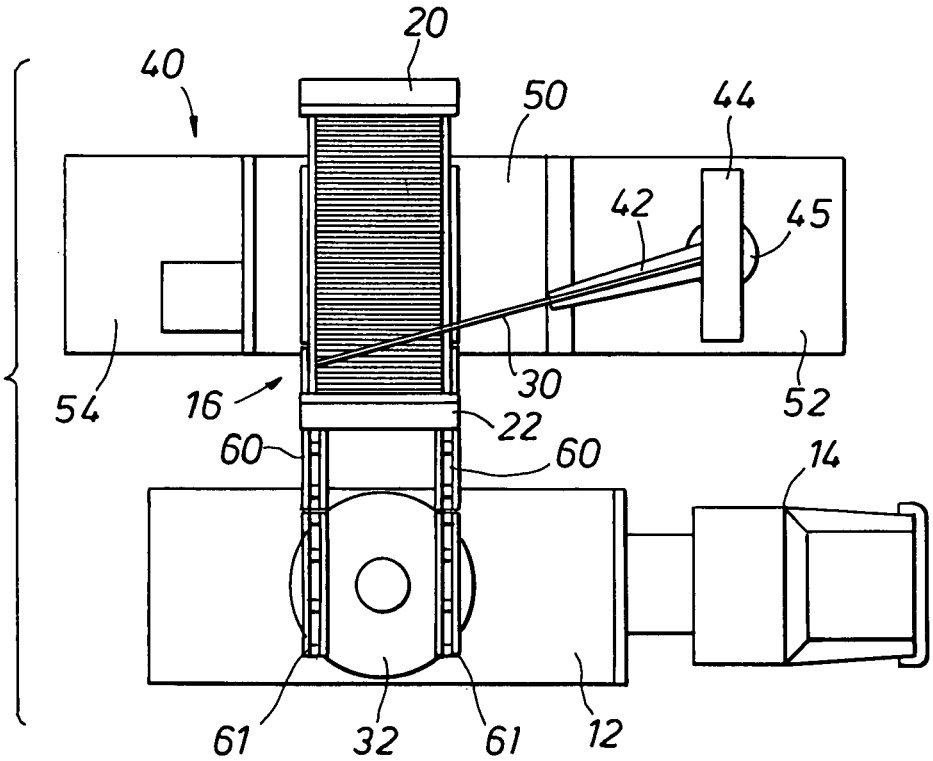
FIG. 4 is a view similar to FIG. 3 showing the reel of coiled tubing having been transferred from one of the carriers to the other carrier and the coiled tubing from the reel connected to a coiled tubing injector.
Figure 5:
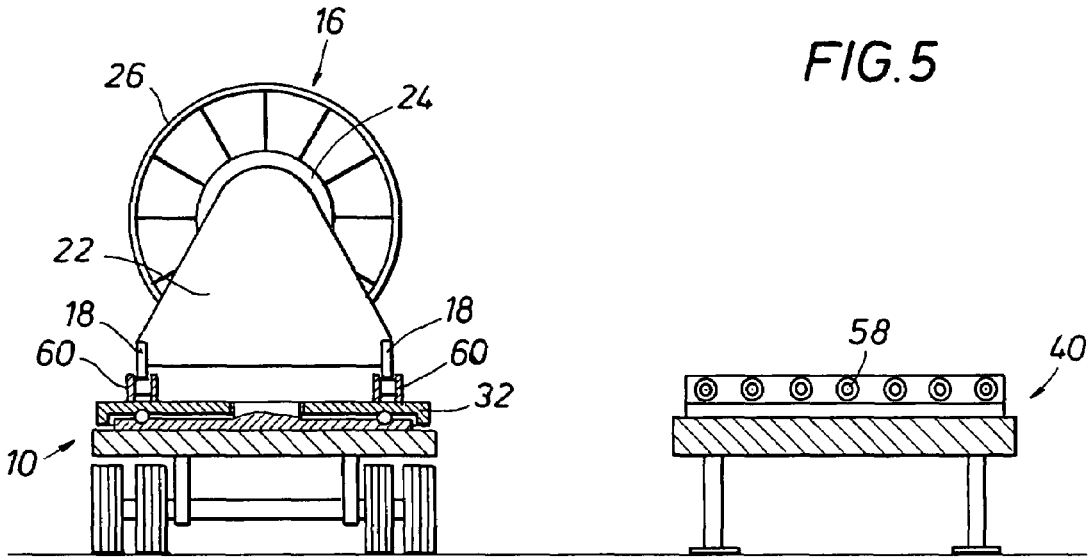
FIG. 5 is a side, elevational view of the arrangement shown in FIG. 1.
Figure 6:
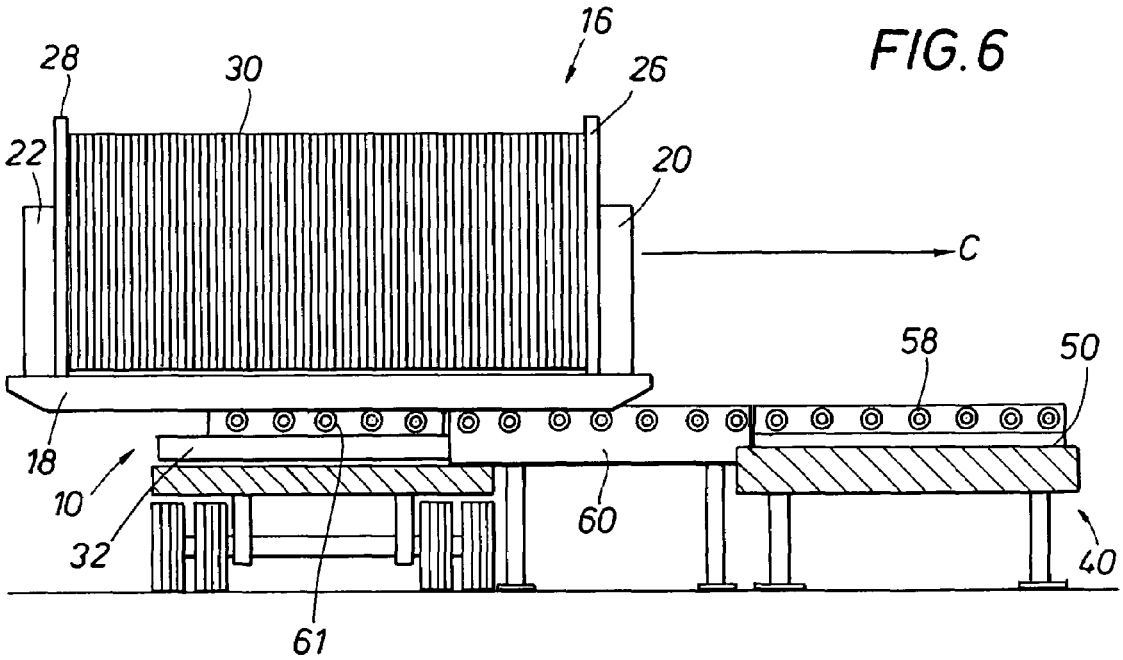
FIG. 6 is a side, elevational view of the arrangement shown in FIG. 3.
Figure 7:
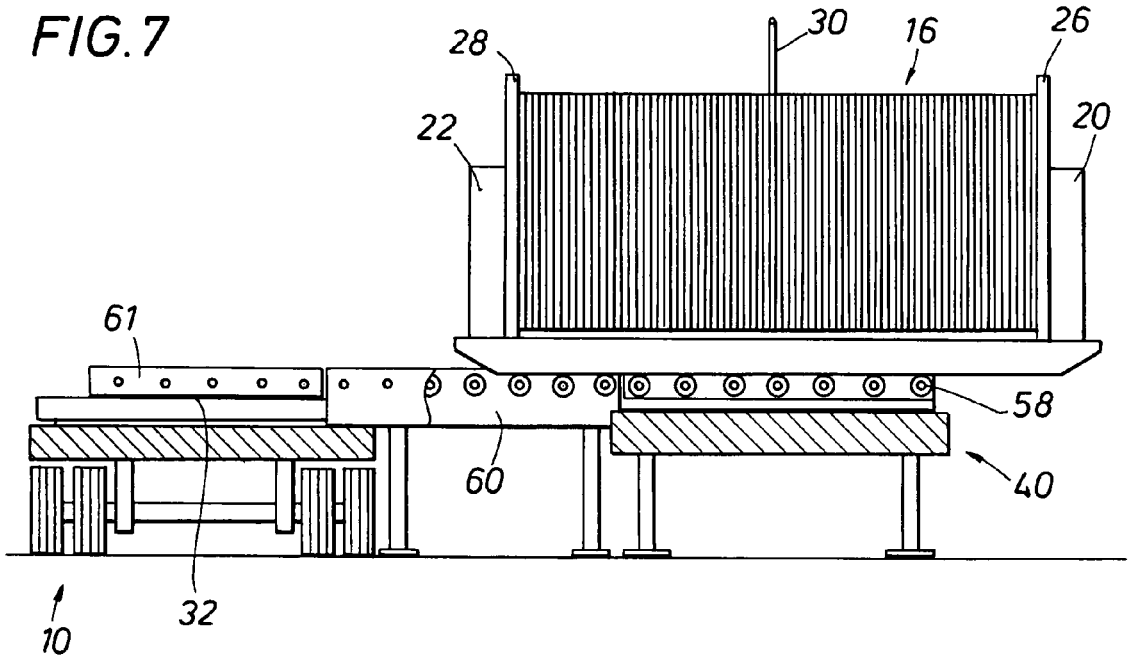
FIG. 7 is a side, elevational view of the arrangement shown in FIG. 4.

Referring then to FIGS. 1-8, there is shown a wheeled carrier 10 having a bed 12, wheeled carrier 10 being pulled by a tractor 14 or other such self-propelled vehicle. Rotatably mounted on bed 12 is a carousel 32, a reel 16 of coiled tubing being removably positioned on carousel 32. As best seen in FIGS. 5 and 6, reel 16 comprises a base 18, and first and second spaced spool supports 20 and 22 attached to and extending upwardly from base 18. A spool is rotatably journaled, in the well-known manner in supports 20 and 22, the spool comprising a drum or core 24 and a pair of axially spaced side rims 26 and 28. Wound around core 24 is a length of coiled tubing 30.

As can be seen, bed 12 has a length indicated by arrow A and a width indicated by arrow B, the length A being greater than the width B. The core 24 of the spool has a long or rotation axis shown in dotted lines as 25, extending between supports 20 and 22, long axis 25 having a length between supports 20 and 22 greater than the width B of bed 12. Additionally, the longest dimension of the reel 16 that is transverse to the long axis 25 of the core 24 is approximate to or less than the width B of the bed 12, wherein "approximate to" includes "equal to". This relative dimensioning between the bed 12 and the reel 16 is important since, in the preferred case, carrier 10 is designed to be transported or movable on government regulated roads, highways and the like. Accordingly, by making the longest dimension of the reel 16 which is transverse to the long axis 25 of the core 24 approximate to or less than the width B of the bed 12, and assuming the height is appropriate, wheeled carrier 10 with reel 16 can move freely along such regulated roads, highways, etc. It should be noted that restrictions on the length of a trailer or the like, moving on regulated roads, highways, etc., are more liberal than height or width restrictions. It is common, for example, to use tractor-trailer rigs wherein the trailer has a length of 40' or more. Thus, the present invention allows for a much longer length of coiled tubing to be transported than is afforded by the prior art. In this regard, prior art transport systems for coiled tubing utilize a system wherein the axis of the core of the spool between the spool supports is transverse to the length A of the bed on which the reel is supported or rests. This necessarily restricts the length of the core of the spool between the rims and accordingly restricts the length of coiled tubing that can be transported.

There is a second wheeled carrier 40, wheeled carrier 40 comprising a trailer or platform on which is mounted a coiled tubing system including a gooseneck or guide 42 which is operatively connected to a mast shown schematically as 44 whereby coiled tubing may be injected into and removed from a wellbore over which mast 44 is centered by means of a coiled tubing injector 45. As is well understood in the art, in addition to mast 44, coiled tubing injector 45 and gooseneck 42, typically carrier 40 would also carry a lifting device to support the injector and gooseneck and a hydraulic power pack to provide power to the reel and the injector and to other hydraulic equipment, none of which are shown for simplicity. As will be seen hereafter, wheeled carrier 40 can have the same dimension, relative to width and length, as described above with respect to wheeled carrier 10. However, it will be understood that carrier 40 need not have the same dimensional characteristics as carrier 10 albeit that it will typically have a length extending from a first end 46 to a second end 48 which is longer than a width extending from a first side 51 to a second side 53. Wheeled carrier 40 has a central bed 50 disposed between raised end beds 52 and 54, bed 50 being provided with conveyor tracks 56 and 58, conveyor tracks 56 and 58 having their long axes generally perpendicular to the sides 51, 53 of wheeled carrier 40.

Figure 1:
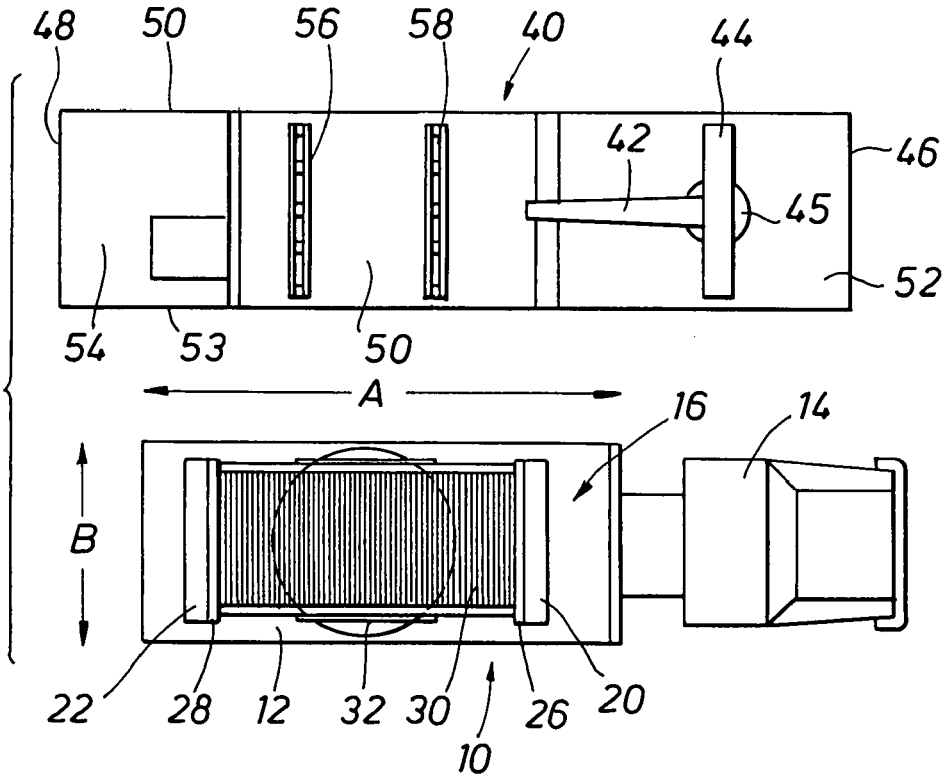
FIG. 1 is a top plan view of first and second carriers used in one preferred embodiment of the apparatus and method of the present invention.

FIG. 1 depicts an arrangement in which wheeled carrier 10, pulled by tractor 14, has arrived at a given site at which is located wheeled carrier 40 which, as noted above, carries the components of a typical coiled tubing injector system. In any event, in the position shown in FIG. 1, tractor 14 has positioned carrier 10 alongside platform 40 with long axis 25 of core 24 being generally parallel to the length of platform 40.

Figure 2:
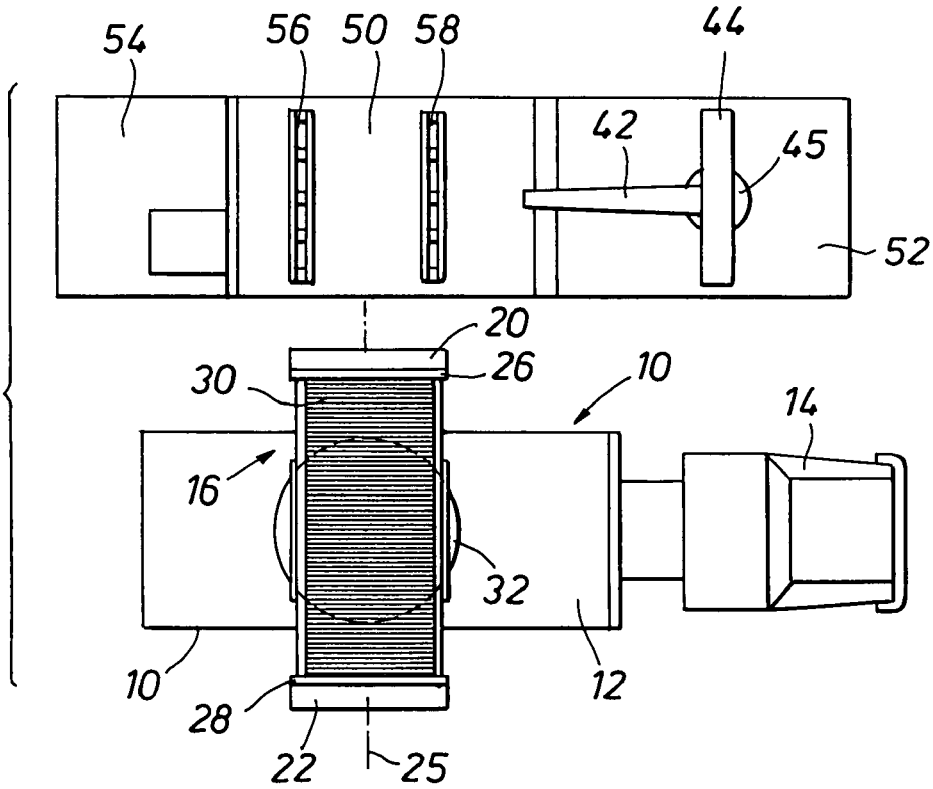
FIG. 2 is a view similar to FIG. 1 showing a reel of coiled tubing on one of the carriers rotated 90° from the position shown in FIG. 1.
Figure 3:
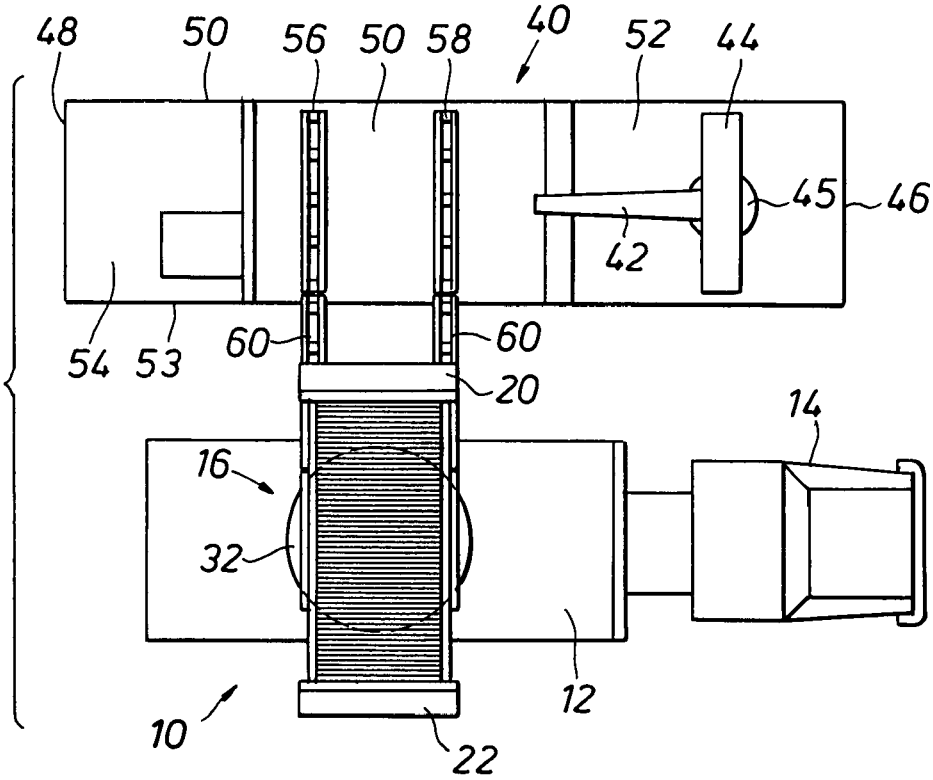
FIG. 3 is a view similar to FIG. 2 showing the reel of coiled tubing in a position to be moved from one of the carriers to the other of the carriers.
Figure 8:
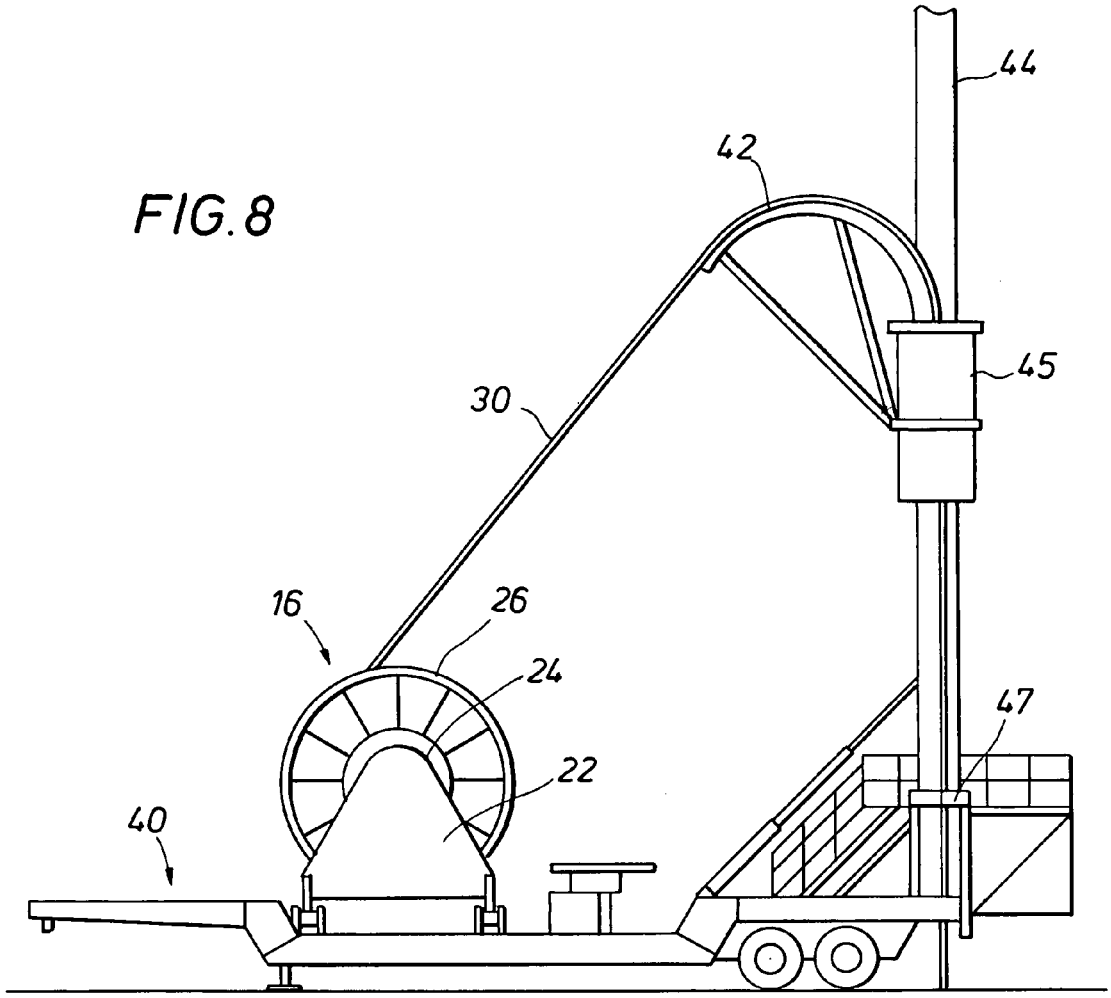
FIG. 8 is a side, elevational view of coiled tubing being injected into a well to perform earth borehole operations.

Turning to FIG. 2, carousel 32 has been rotated such that the reel 16 is now rotated 90° from the position shown in FIG. 1. In this position, the long axis 25 of the core 24 is now transverse, e.g., perpendicular to the length of carrier 40. As can best be seen in FIG. 6, wheeled carrier 10 is provided with a conveyor track system including telescoping conveyor tracks 60, only one of which is shown, which can be extended and retracted from wheeled carrier 10. As shown in FIGS. 5 and 6, once wheeled carrier 10 has been positioned, initially as shown in FIG. 1, and carousel 32 rotated 90° to rotate reel 16 to the position shown in FIG. 2, telescoping conveyor tracks 60 are telescoped out to engage bed 50 on carrier 40. As seen, telescoping conveyor tracks 60, when extended, form a continuous conveyor with conveyor tracks 56, 58 on carrier 40 and conveyor tracks 61 on carrier 10, such that reel 16 can now be moved in a suitable fashion by any number or ways in the direction of arrow C off of carrier 10 on to carrier 40. As seen at FIGS. 4 and 8, once reel 16 has been positioned on carrier 40, coiled tubing 30 is then connected to coiled tubing injector 45 via gooseneck 42 and mast 44 such that coiled tubing 30 can be injected into the wellbore through wellhead 47 (see FIG. 8). Transfer of reel 16 from carrier 10 to carrier 40 and the connection of coiled tubing 30 to coiled tubing injector 45 is shown in plan view in FIGS. 1-4 and in elevation in FIGS. 5-8.

Figure 9:
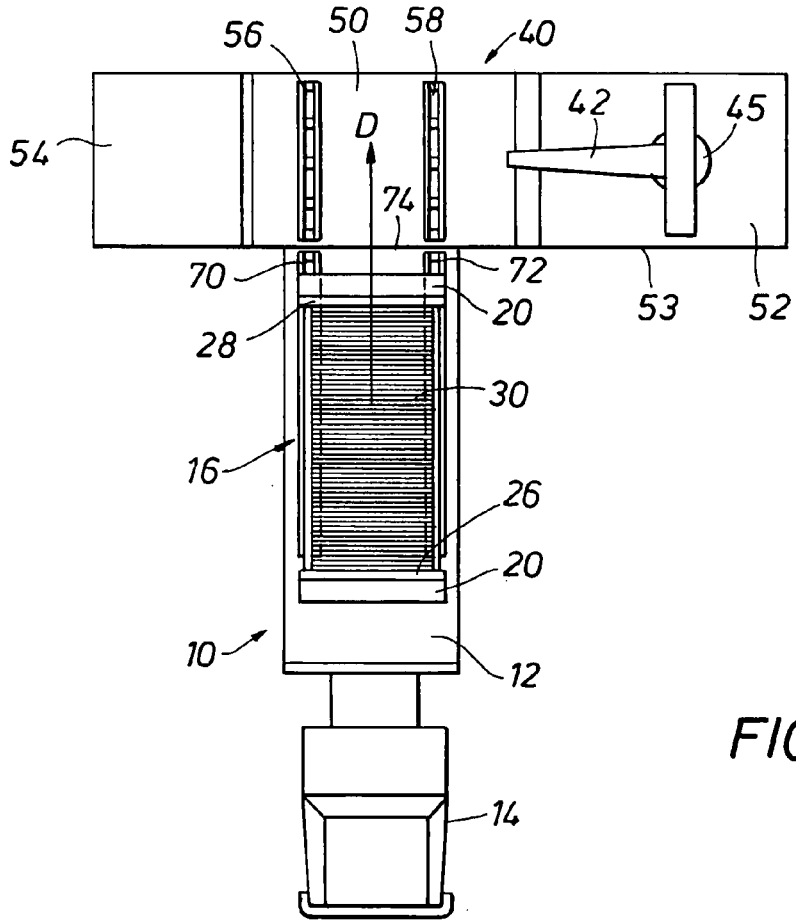
FIG. 9 is a top plan view showing another preferred embodiment of the present invention for transferring coiled tubing from a first carrier to a second carrier.

Referring to FIG. 9, there is shown another embodiment of the present invention. In the embodiment shown in FIG. 9, the reel 16 of coiled tubing resting on the bed 12 of carrier 10 is positioned in the same manner as shown in FIG. 1, i.e., with the long axis of the core 24 being generally parallel to the length A of bed 12. However, in this embodiment, it is not necessary that carrier 10 be equipped with a carousel such as carousel 32. Rather, reel 16 rests on conveyor tracks 70, 72 that run generally parallel to one another and along the length of bed 12. In the method employed in the embodiment depicted in FIG. 9, carrier 10 is positioned proximate carrier 40 such that the end 74 of bed 12 is proximate side 53 of carrier 40 which carries tracks 56 and 58. Essentially, the long axis of the core 24 is generally perpendicular to the length of carrier 40. As can be seen, tracks 70 and 72 are generally in register with tracks 56 and 58, respectively. Thus, by movement of reel 16 in the direction of arrow D, reel 16 can be moved onto carrier 40, following which carrier 10 can be pulled away by tractor 14. While reference has been made to tracks, e.g., tracks 56 and 58, which can be mounted on both of the carriers to move the reel of coiled tubing from one carrier to the other carrier, it will be understood that tracks are not necessary. The reel of coiled tubing can be moved by lifting with a suitable crane or other lifting device off of one carrier and placed on the other carrier. Additionally, the reel of coiled tubing can be positioned on a skid or other slidable support or platform which can simply be slid off the bed of one carrier onto the bed of the other carrier. It is also to be understood that the word "proximate" as used in the present application is not intended to mean only "touching", "closely adjacent", or similar terms, but rather is intended to have a meaning which encompasses being nearer to one point than to another point, the overall idea being that when reference is made to one carrier, bed or the like being proximate another carrier, bed or the like, the two are in a positionable relationship, sufficiently close to one another to permit a desired act, motion or the like to be accomplished. For example with reference to FIG. 9, it is not necessary that the end 74 of bed 12 be touching the side 53 of carrier 40. Indeed, as explained above, since reel 16 could be moved from carrier 10 to carrier 40 by means of a crane, carrier 10 could be positioned a substantial distance away from carrier 40 but be in sufficient proximity that the required action of moving the reel 16 from carrier 10 to carrier 40 could be accomplished by such crane or other lifting device.

Figure 10:
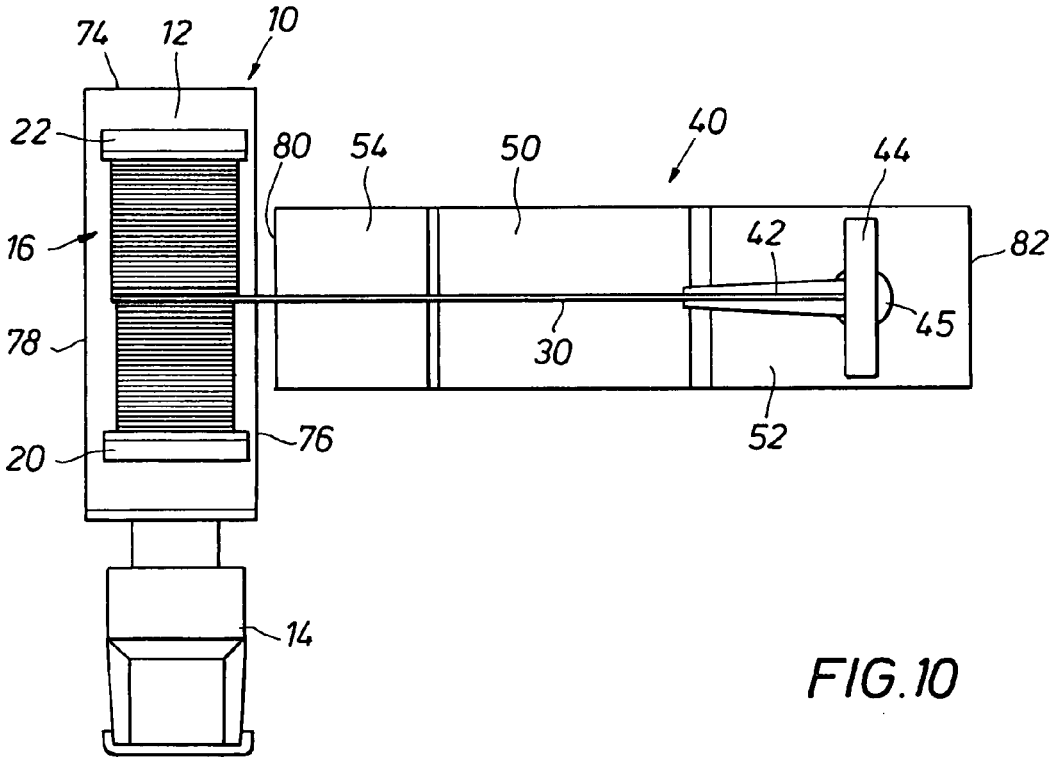
FIG. 10 is a top plan view of yet another preferred embodiment of the present invention wherein coiled tubing from a carrier is attached directly to a coiled tubing injector, the reel of coiled tubing and the coiled tubing injector being located on a first side of a well.

FIG. 10 shows another, slightly modified embodiment of the present invention, wherein tractor 14 positions carrier 10 such that one side 76 of bed 12 is moved proximate an end 80 of carrier 40, mast 44 being disposed proximate the opposite end 82 of carrier 40. In this position, coiled tubing 30 can be attached via guides 42 and mast 44 to coiled tubing injector 45 while reel 16 remains on bed 12 of carrier 10. Accordingly, in this embodiment, carrier 10 need not have a carousel, any conveyor system or the like since reel 16 remains at all times on carrier 10 while coiled tubing 30 is being used.

Figure 11:
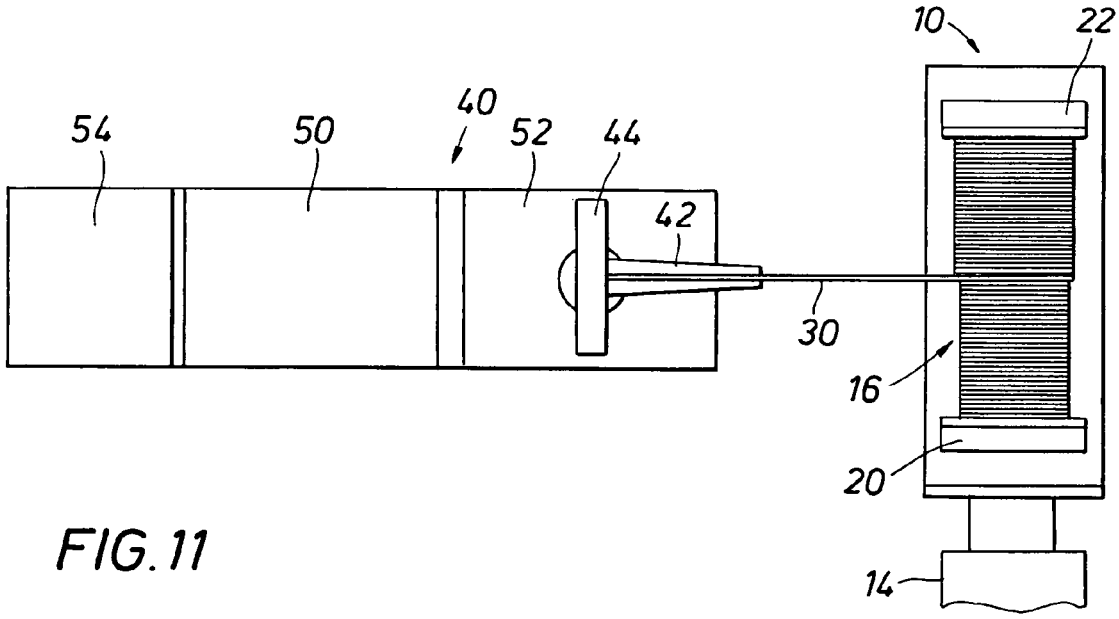
FIG. 11 is a view similar to FIG. 10 but showing the coiled tubing injector and the reel of coiled tubing on an opposite, second side of the well from the position shown in FIG. 10.

FIG. 11 shows an embodiment similar to that in FIG. 10 with the exception that carrier 40 in FIG. 11 has guide 42 disposed on the opposite side of the mast 44 from the position shown in FIG. 10. In essence, the only difference between the embodiment shown in FIG. 10 and FIG. 11 is the position of the guide 42 relative to the mast 44 or the wellbore.

Figure 12:
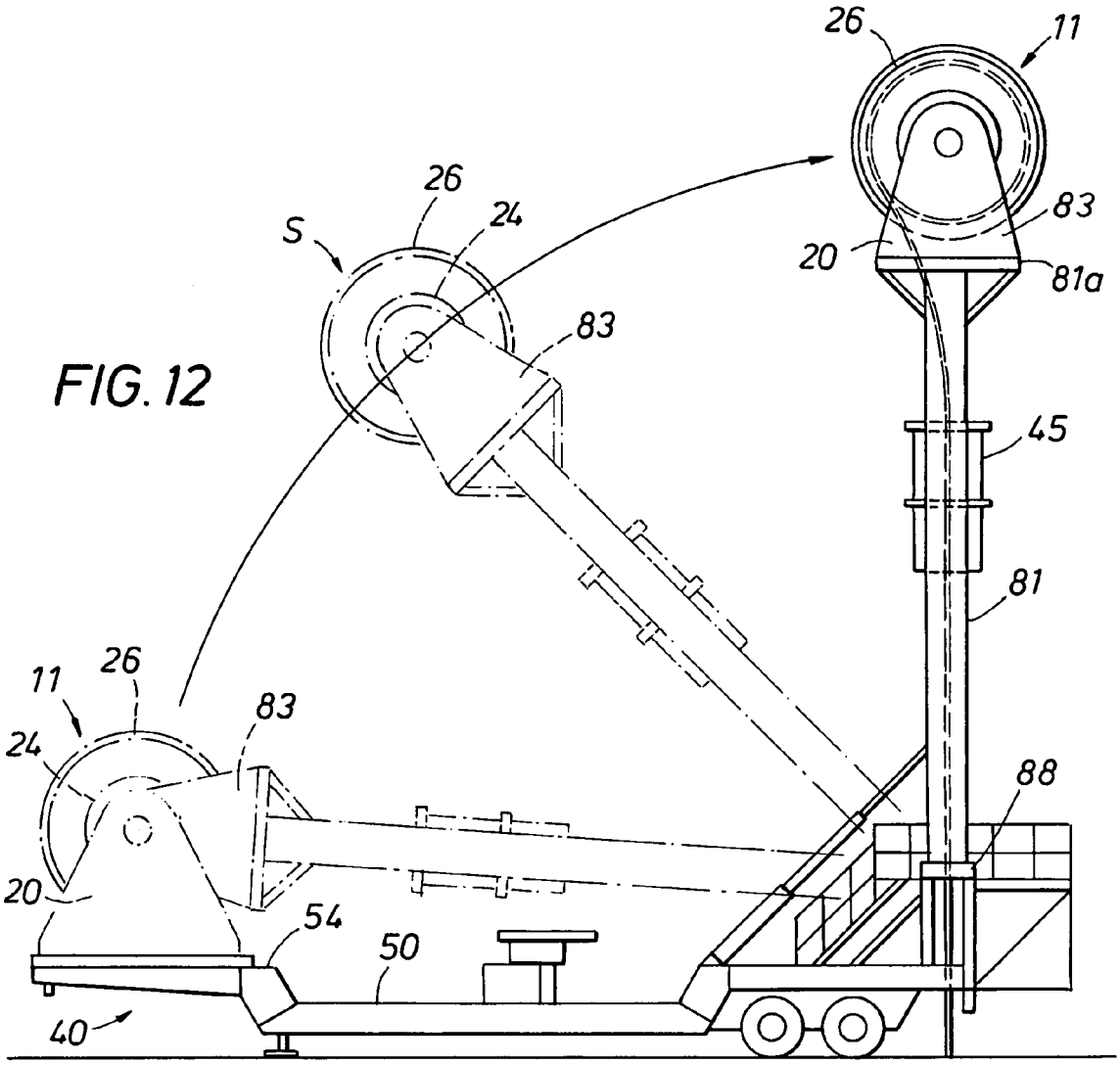
FIG. 12 is an elevational view showing another preferred embodiment of the present invention wherein a reel of coiled tubing transferred to a carrier having a mast is moved by the mast to a position generally above a wellbore.
Figure 13:
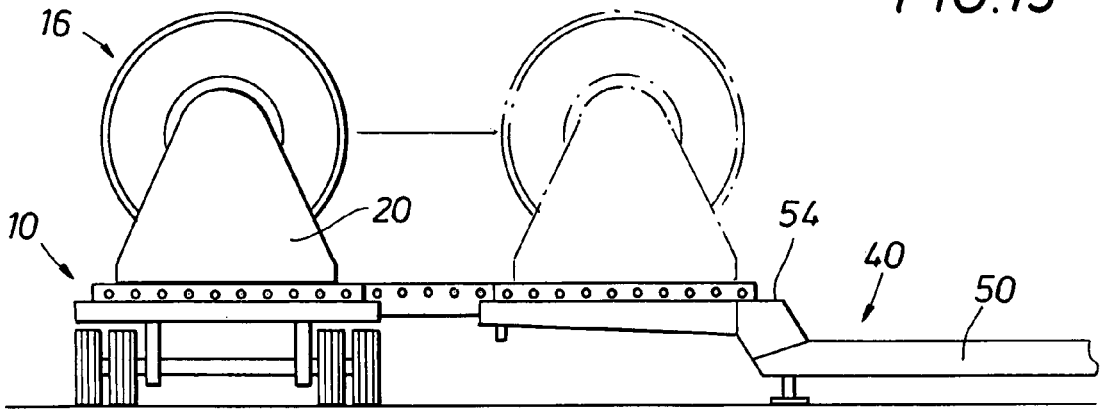
FIG. 13 is a view showing the reel of coiled tubing being moved from one carrier to the position on a second carrier shown in FIG. 12.

FIG. 12 depicts an embodiment wherein reel 16 has been positioned on the bed portion 54 of carrier 40. In the embodiment shown in FIG. 12, mast 81, at crown 81*a*, has a mechanism 83, schematically shown but well known to those skilled in the art, which can engage and fixedly, releasably attach to spools S of reel 16 when mast 81 is moved to a substantially horizontal position as shown in phantom in FIG. 12. The mast 81 can then be pivoted to a substantially vertical position as shown in FIG. 12 whereby spool S is now resting on the crown 52 of mast 80. Coiled tubing can then be unwound from spool S and introduced via injector 45 into the wellbore through rotary table 88. In the embodiment shown in FIG. 12, the spool S comprised of the core 24, rims 26 and 28 and the axle passing through the core 24, would be detached from the supports 20, 22. Systems for accomplishing the technique described and depicted in FIG. 12 are well known to those skilled in the art. In connection with the embodiment shown in FIG. 12, FIG. 13 depicts the movement of the reel 16 from carrier 10 onto bed 54 of carrier 40.

Figure 14:
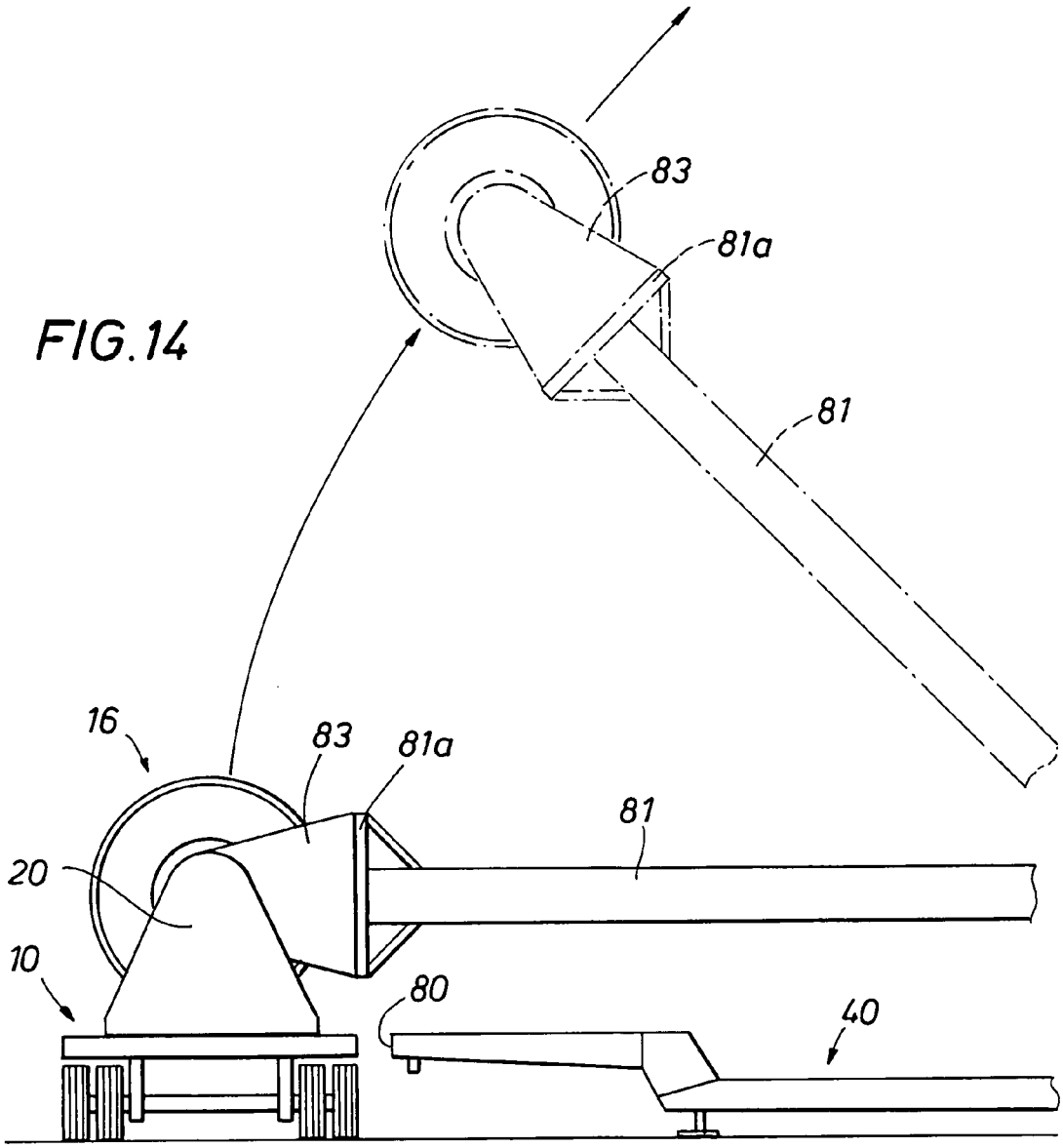
FIG. 14 is an elevational view showing another preferred embodiment of the present invention wherein the reel of coiled tubing on a first carrier is picked up by a mast mounted on a second carrier to be moved to an off-horizontal position.

FIG. 14 depicts a slightly modified version of that shown in FIG. 12 wherein, instead of moving reel 16 from carrier 10 to carrier 40, reel 16 is left on carrier 10 and mast 81 is attached to spool S of reel 16 which is then detached from the supports 20, 22 and moved off carrier 10 and into a substantially vertical position or at least a position transverse to the horizontal such as is done in the embodiment shown in FIG. 12.

Figure 15:
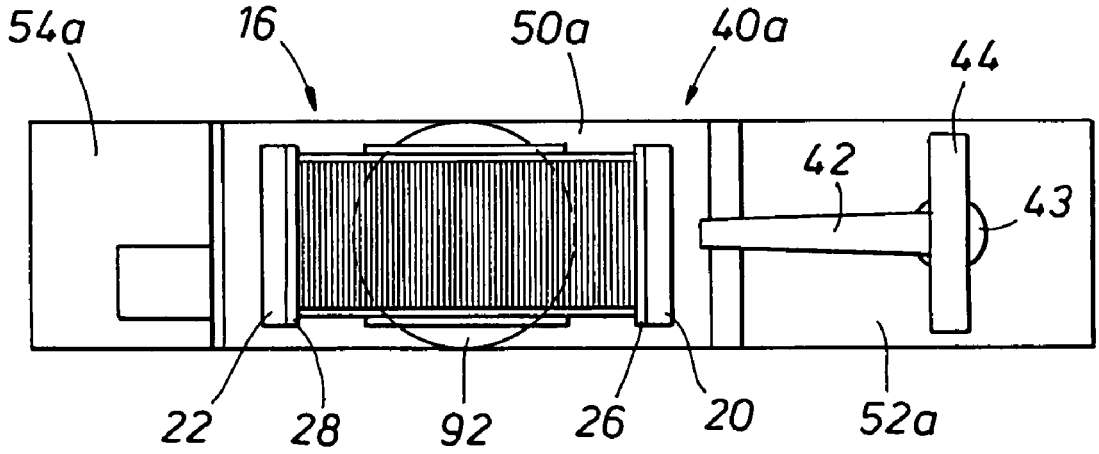
FIG. 15 is a top plan view of another preferred embodiment of the present invention wherein the reel of coiled tubing is mounted in the first position on a first carrier, the first carrier having a mast mounted thereon.
Figure 16:
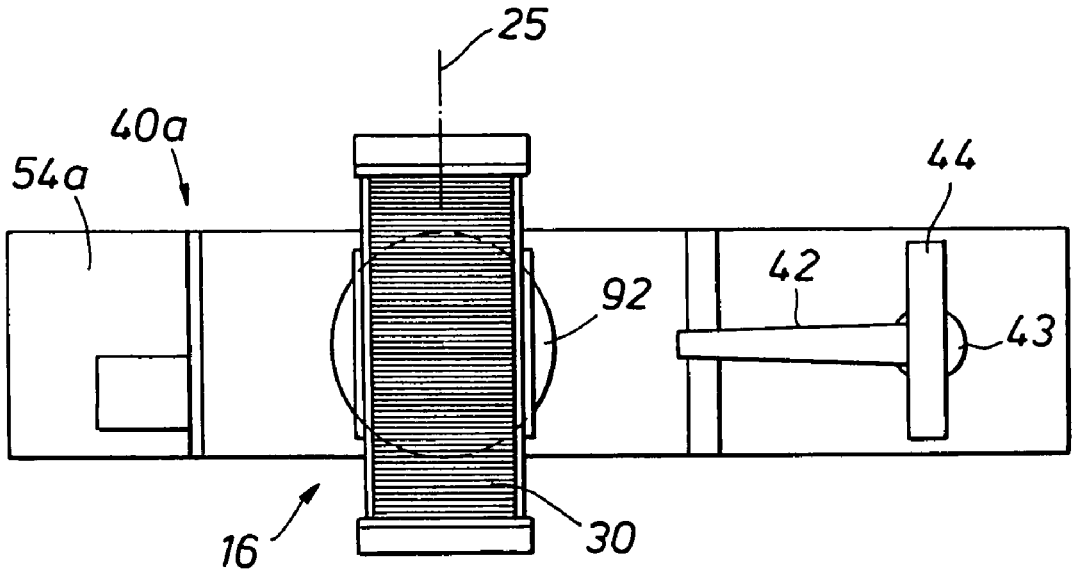
FIG. 16 is a view similar to FIG. 15 but showing the reel of coiled tubing rotated 90° relative to that shown in FIG. 15.

FIGS. 15 and 16 show yet another embodiment of the present invention wherein carrier 40*a*, which carries a mast 44, guide 42 and coiled tubing injector 45, has a carousel 92 on which rests a reel 16 of coiled tubing. As seen in FIG. 15, reel 16 is positioned on carrier 40*a* such that the long axis 25 of the core 24 extends lengthwise along carrier 40*a*. In this mode, and if carrier 40*a* was a wheeled carrier such as a trailer or the like and assuming that the height and width of carrier 48 did not otherwise violate government regulations regarding size limitations on vehicles transporting over government controlled roads, carrier 40*a* could be pulled to a rig site and then carousel 92 rotated 90° to orient reel 16 in the position shown in FIG. 16. In this position, coiled tubing 30 from reel 16 could be played off core 24, passed through guide 42, and attached to coiled tubing injector 45.

The word "carrier" as used herein is intended to include any platform, trailer, skid or other support which is preferably movable. In the case where the carrier is traveling on roads, highways, etc., subject to government regulation as to height, width, etc., the carrier and coiled tubing reel will usually have the relative dimensions described above with respect to the embodiments shown in FIGS. 1 and 2. The term "approximate to" as used with respect to the length of the long axis of the core vis-a-vis the width of the bed of the carrier encompasses a length of the long axis longer than the width of the bed provided that in the event the carrier is to be moved on roads, highways, etc., subject to government regulation, the overall length of the coiled tubing reel, as measured along the axis of the core, does not violate such regulations.

As can be seen from the above, the present invention provides a system wherein a reel of coiled tubing can be transported on one carrier to a site where another carrier is located and the reel of coiled tubing moved from the carrier on which it was transported to the carrier located at the site. Additionally, the present invention provides a carrier which can comprise a typical coiled tubing injection trailer in the sense that it has a mast mounted thereon along with peripheral equipment described above used in coiled tubing injection operations and which can also be moved along roads, highways, etc., subject to government regulation. In the latter case, and as seen with respect to FIGS. 15 and 16, when in transport, the reel 16 is positioned as shown in FIG. 15, but when it is desired to use the coiled tubing, the reel of coiled tubing is rotated 90° to the position shown in FIG. 16. FIGS. 15 and 16 point to a distinct advantage of the system of the present invention. Because of the axial length of the spool, a much longer length of coiled tubing can be transported over regulated roads, highways, etc., as compared with prior art systems wherein the reel of coiled tubing mounted on a typical coiled tubing injector carrier, e.g., a trailer, could have the same height as the coiled tubing reel used in the present invention, but the axial length of the spool would have to be considerably shorter. Thus, for the same OD of the coiled tubing and for a given diameter of the core, the prior art systems employ a considerably shorter length of coiled tubing than the system of the present invention.

While the coiled tubing transport system of the present invention is ideally suited for coiled tubing having an OD of from about 1" to about 4", it is to be understood that it can be utilized with coiled tubing or other continuous tubular products having an OD of up to 9".

As is well known, in the case of reels of coiled tubing, particularly of the type used in oil and gas well drilling and servicing operations, the diameter of the core of the spool of the coiled tubing reel, is sized to accommodate the OD of the coiled tubing wound thereon. Thus, with coiled tubing having an OD ranging from 1" to 9", the diameter of the core of the spool will be such that the ratio of the OD of the coiled tubing to the diameter of the spool will range from about 1:20 to about 1:70. Generally speaking, the industry standard is a core diameter of 40 times the OD of the coiled tubing. However, in larger size coiled tubing this ratio typically is not achievable and the following table shows suggested minimum recommended core diameters for coiled tubing having different ODs.

| Coiled Tubing OD | Recommended Minimum Core Diameter |
|---|---|
| 1.25" | 72" |
| 1.50" | 84" |
| 1.75" | 90" |
| 2.00" | 96" |
| 2.38" | 100" |
| 2.88" | 110" |
| 3.50" | 130" |

As noted above, while most coiled tubing is made of steel, the present invention contemplates the use of coiled tubing made of composites as described above. The use of composites which, as recognized, generally have more elasticity than steel generally permits the use of smaller core diameters for a given OD of the coiled tubing than can be achieved using coiled tubing made of steel.

In most cases, the carrier on which the mast is mounted will be dimensioned such that it can travel on roads, highways, etc., subject to government regulation. Thus, with the mast pivoted to a generally horizontal position, such a carrier can freely travel on such roads, highways, etc. However, it needs to be recognized that the mast and other equipment used in coiled tubing operations could be mounted on a platform which, albeit movable by some means, because of its dimensions could not travel or be moved along such regulated roads, highways, etc.

The term "carousel" as used herein is intended to include any apparatus which can effect rotation of the reel of coiled tubing or skid on which it is mounted. Thus, a rotatable axle, spindle or the like connected to a suitable support (skid) or the base of the reel of coiled tubing and which can be rotated, either mechanically or manually, to turn the skid or base, qualifies as a carousel.

The foregoing description and examples illustrate selected embodiments of the present invention. In light thereof, variations and modifications will be suggested to one skilled in the art, all of which are in the spirit and purview of this invention.

What is claimed is:

1. A coiled tubing transfer system comprising:

a first wheeled carrier or skid, said first carrier or skid having a first bed, said bed having a width and a length, said length of said first bed being longer than said width of first bed;

a reel removably supported on said first bed, said reel comprising first and second spaced supports, and a spool rotatably journaled to said first and second supports, said spool having a core with a diameter and a long axis extending between said first and second supports, said long axis having a length greater than said width of said first bed, said reel being positionable on said first bed in a first position with said long axis of said core extending lengthwise of said first bed, the longest dimension of said reel that is transverse to said long axis being approximately equal to or less than said width of said first bed;

a second wheeled carrier or second skid, said second wheeled carrier or second skid comprising a mast mounted on said second wheeled carrier or second skid, said mast being moveable from an approximate horizontal position to a position transverse to the horizontal;

said reel being moveable from said first wheeled carrier or first skid to said second wheeled carrier or second skid;

a conveyor for moving said reel from said first wheeled carrier or first skid to said second wheeled carrier or second skid; and a length of coiled tubing usable in earth borehole operations wound around said core, said coiled tubing having an outside diameter of from about 1" to 9", the ratio of the diameter of said coiled tubing to said diameter of said core being from 1:20 to 1:70.

2. The coiled tubing transfer system of claim 1, wherein said first wheeled carrier comprises a trailer.

3. The coiled tubing transfer system of claim 1, wherein said first wheeled carrier is adapted to be pulled by a self-propelled vehicle.

4. The coiled tubing transfer system of claim 1, further comprising:

a carousel rotatably mounted on said first bed, said reel being positionable on said carousel, said carousel being rotatable to move said reel from said first position to a second position wherein said long axis of said core is generally transverse to said length of said first bed.

5. The coiled tubing transfer system of claim 1, wherein second wheeled carrier or second skid has a second bed, said second bed having a width and a length, said length of said second bed being longer than said width of said second bed, said reel being movable to said second bed with said long axis of said core extending transversely to said length of said second bed.

6. A method of transporting and using a reel of coiled tubing comprising:

providing a first wheeled carrier or skid, said first carrier or skid having a first bed, said first bed having a width and a length, said length of said first bed being longer than said width of said first bed;

providing a second wheeled carrier or second skid, said second wheeled carrier or second skid comprising a mast mounted on said second wheeled carrier or second skid, said mast being movable from an approximate horizontal position to a position transverse to the horizontal;

positioning a reel of coiled tubing on said first bed, said reel comprising a base, first and second spaced supports extending generally upwardly from said base, and a spool rotatably journaled in said first and second supports, said spool having a core with a diameter and a long axis extending between said first and second supports, said long axis having a length that is greater than the width of said first bed, said reel being positionable on said first bed in a first position with said long axis of said core extending lengthwise of said first bed, the longest dimension of said reel that is transverse to said long axis being approximately equal to or less than the width of said first bed;

winding a length of coiled tubing around said core, said coiled tubing being of a type used in earth borehole operations, said coiled tubing having an outside diameter of from 1" to 9", the ratio of said diameter of said coiled tubing to said diameter of said core being from 1:20 to 1:70;

transporting said first carrier and said reel carrying said length of said coiled tubing to a desired site;

moving said reel from said first wheeled carrier or first skid to said second wheeled carrier or second skid;

connecting said coiled tubing to a coiled tubing injector; and utilizing said coiled tubing in an earth borehole operation.

7. The method of claim 6, wherein said first wheeled carrier comprises a trailer.

8. The method of claim 6, wherein said first wheeled carrier is adapted to be pulled by a self-propelled vehicle.

9. The method of claim 6, further comprising:

providing a carousel rotatably mounted on said first bed, said reel being positionable on said carousel, said carousel being rotatable to move said reel from said first position to a second position wherein said long axis of said core is generally transverse to said length of said first bed.

10. The method of claim 6, further comprising:

providing a conveyor for moving said reel from said first wheeled carrier or first skid to said second wheeled carrier or second skid.

11. The method of claim 6, wherein said second wheeled carrier or second skid has a second bed, said second bed having a width and a length, said length of said second bed being longer than said width of said second bed, said reel being positionable on said second bed with said long axis of said core extending transversely to said length of said second bed.

12. The method of claim 9, comprising rotating said carousel to said second position and moving said reel from said first wheeled carrier or skid to said second wheeled carrier or skid.

13. The method of claim 6, wherein said reel is movable from said first wheeled carrier or first skid to said second wheeled carrier or second skid, said second wheeled carrier or second skid having a second bed, said second bed having a width and a length, said length of said second bed being longer than said width of said second bed, and comprising moving said first wheeled carrier or first skid adjacent said second wheeled carrier or second skid such that said length of said first bed of said first wheeled carrier or first skid is transverse to said length of said second bed of said second wheeled carrier or second skid, and moving said reel from said first wheeled carrier or first skid to said second wheeled carrier or second skid.

14. The method of claim 13, wherein said first bed has first and second sides and first and second ends, and said second bed has first and second sides and first and second ends, said mast being mounted on said second bed proximate said first end of said second bed, and comprising moving said first wheeled carrier or first skid such that one side of said first bed is proximate said second end of said second bed.

15. The method of claim 13, wherein said bed has first and second sides and first and second ends, and said second bed has first and second sides and first and second ends and comprising moving said first wheeled carrier or first skid to a position such that one end of said first bed is proximate one side of said second bed.

16. The method of claim 6, wherein said second bed has first and second sides and first and second ends, said second bed has first and second sides and first and second ends, and said mast is mounted proximate said first end of said second bed and comprising moving said first wheeled carrier or first skid to a position proximate said second wheeled carrier or second skid such that one side of said first bed is proximate said second end of said second bed, and connecting coiled tubing from said reel to said coiled tubing injector with said reel remaining on said first wheeled carrier or first skid.

17. The method of claim 6, wherein said first bed has first and second sides and first and second ends, and said second side has first and second sides and first and second ends, said mast being positioned proximate said first end of said second bed, and comprising positioning said first wheeled carrier or first skid such that one of said sides of said first bed is proximate said second end of said second bed, moving said mast to an approximate horizontal position, fixedly releasably engaging said mast with said reel, and moving said mast carrying said reel to a position generally transverse to said approximate horizontal position.

18. The method of claim 9, comprising rotating said carousel to move said reel from said first position to said second position and connecting coiled tubing from said reel to said coiled tubing injector.

* * * * *